US007713062B2

(12) United States Patent
Welling

(10) Patent No.: US 7,713,062 B2
(45) Date of Patent: May 11, 2010

(54) SHOELACE PULL TAB FOR FACILITATING AND TEACHING LACE TYING

(76) Inventor: Wendy Welling, 2024 Park Vista Ct., Santa Rosa, CA (US) 95405

( * ) Notice: Subject to any disclaimer, the term of this patent is extended or adjusted under 35 U.S.C. 154(b) by 656 days.

(21) Appl. No.: 11/725,817

(22) Filed: Mar. 19, 2007

(65) Prior Publication Data

US 2008/0229562 A1 Sep. 25, 2008

(51) Int. Cl.
*G09B 19/24* (2006.01)

(52) U.S. Cl. ..... 434/260

(58) Field of Classification Search ..... 434/258, 434/260; 24/712, 712.1, 712.2, 712.4
See application file for complete search history.

(56) References Cited

U.S. PATENT DOCUMENTS 2,646,630 A * 7/1953 Miller ..... 434/260
3,070,863 A * 1/1963 Eberwein ..... 24/712.2
4,017,984 A * 4/1977 Bonfigli ..... 434/260
4,978,304 A * 12/1990 Alexander ..... 434/260
5,240,418 A * 8/1993 Silverman et al. ..... 434/260
5,372,510 A * 12/1994 Stanfield ..... 434/260
5,562,457 A * 10/1996 Haslam ..... 434/260
6,746,249 B1 * 6/2004 Claunch ..... 434/260
7,309,235 B2 * 12/2007 Wilk ..... 434/260
7,404,583 B1 * 7/2008 Hassen ..... 289/1.5

* cited by examiner

*Primary Examiner*—Kurt Fernstrom
(74) *Attorney, Agent, or Firm*—Donald W. Meeker

(57) ABSTRACT

A shoelace pull tab device for facilitating and teaching lace tying. The shoelace pull tab comprises a small flat beadlike device having two spaced apertures therethrough which are tapered and angled. The lace end of a lace member is threaded up through a first aperture and down through a second aperture to create a gripping pull tab which will not slide/move its position at the newly created apex of the loop in the lace. The pull tab provides a grip or pull tab for children to manipulate the laces into a bow. Indicia on the pull tabs are used as action characters or objects in a story-telling teaching method for learning shoelace tying wherein the action characters or objects engage in activities directly related to the actions necessary for tying a shoelace.

4 Claims, 1 Drawing Sheet

SHOELACE PULL TAB FOR FACILITATING AND TEACHING LACE TYING

CROSS-REFERENCE TO RELATED APPLICATIONS

Not Applicable.

STATEMENT REGARDING FEDERALLY SPONSORED RESEARCH OR DEVELOPMENT

Not Applicable.

THE NAMES OF THE PARTIES TO A JOINT RESEARCH OR DEVELOPMENT

Not Applicable.

BACKGROUND OF THE INVENTION

1. Field of the Invention

The present invention relates to shoelace tying training devices and particularly to a shoelace pull tab device for facilitating and teaching lace tying, the pull tab comprising a small beadlike device having two spaced apertures therethrough which are both tapered to squeeze the lace and angled to create friction through which the lace end on lace member is threaded up through a first aperture and down through a second aperture to create a gripping tab which will not slide/move its position on the newly created end of said lace members thereby providing a grip or pull tab for children to manipulate the laces into a bow.

2. Description of Related Art Including Information Disclosed Under 37 CFR 1.97 and 1.98

With the advent of hook and loop fasteners and self closing shoe systems the art of tying ones shoelaces has been lost to many children ages 3-8. As a matter of fact, 75% of children now learn to tie their shoelaces at ages 6 and above.

Many prior art tying methods are approached using the "Bunny-ear or Loop" method which creates too many "holes/loops" and confuses children whose dexterity is not advanced at an early age. Many devices have been proposed to instruct a child to tie a bow in their shoelaces including dolls, books, toys, and practice boards, but none have attached devices to facilitate tying and aid in learning how to tie shoe laces, as does the device and the associated teaching method of the present invention which ultimately allows the child to create a more secure knot.

Prior art U.S. Pat. No. 6,581,256, issued Jun. 24, 2003 to Liu, is for a double-bow shoe lace device for a shoe which includes a shoe lace, a clamp member, a decorative knot, and a pair of pull members. The shoe lace has a first lace segment adapted to be strung on the shoe, and a second lace segment that includes first and second lace portions. The lower ends of the lace portions are anchored on eyelet tabs of the shoe. The clamp member is sleeved slidably on the lace portions. Downward and upward movements of the clamp member along the lace portions result in tightening and loosening of the shoe. The lace portions are anchored on the clamp member to form a pair of loops. The knot is positioned on the clamp member, and has a pair of distal lace ends. Each of the pull members is mounted slidably on a respective one of the loops.

Prior art U.S. Pat. No. 5,372,510, issued Dec. 13, 1994 to Stanfield, claims a shoelace tying aid comprising a combination shoelace and joining device for use by young children or the handicapped, to aid in tying a bow in a shoelace that is mounted on a shoe. The joining device has a pair of permanently connected shoelace holding portions, with a first portion substantially permanently mounted on a shoelace part and a second portion which is child-mountable on a second shoelace part to hold a shoelace end portion in a loop configuration which aids in tying a bow. Each shoelace holding portion forms a passage part through which one of the shoelace parts extends. One joining device includes a pair of clamp parts that can be clamped around the second shoelace part, and that forms the second joining portion. The device includes a flexible strip that holds the clamp parts together and that forms the first holding portion. A teaching kit includes a joining device mounted on a short teaching shoelace that is threaded on a shoe device in the form of a cardboard plate representing a shoe.

Prior art U.S. Pat. No. 5,209,667, issued May 11, 1993 to Stanfield, discloses a teaching shoelace for use by young children or the handicapped, which facilitates tying of a bow by providing a moderately stiff end portion; the stiff end portion can retain a loop shape when a pair of spaced locations on the stiff end portion are temporarily fastened together as by a pair of Velcro retainers. The shoelace is formed of a flexible shoelace core with first and second opposite end portions, and with the first end portion penetrated by a solidified, originally-liquid stiffening material. The shoelace can be made only long enough to leave ends for bow tying, when it projects directly between the uppermost eyelets of a shoe, to train a child rather than to also lace his shoes. The length is small enough that the distance between the middle of the shoelace and the closest Velcro retainer is less than the distance between two Velcro retainers. A short tube is provided through which the shoelace projects, with knots tied at opposite ends of the tube and with the tube lying under the uppermost eyelets of a shoe, to assure that opposite ends of the shoelace are of equal length. The two shoelace locations can be held together by a hook device.

Prior art U.S. Pat. No. 2,646,630, issued Jul. 28, 1953 to Miller, indicates an educational shoelace having spaced and fragmented pictorial representations thereon which when a bow is correctly tied will be positioned as to form a complete pictorial representation.

Prior art U.S. Pat. No. 4,342,557, issued Aug. 3, 1982 to Bandar, concerns device which can be used as an educational means for teaching young children how to tie a double bow knot, particularly in their shoe laces, or as an aid to the handicapped child lacking sufficient manual dexterity in tying such a knot. Basically the device is a planar body member in which is provided two pairs of spaced-apart openings in alignment with one another, the two intermediate openings being connected by a narrow opening or slit. The device allows "bunny ear" loops to be formed in the intermediate spaced-apart openings and to form the double bow knot by making a simple overhand knot with the two "bunny ear" loops.

Prior art U.S. Pat. No. 5,562,457, issued Oct. 8, 1996 to Haslam, describes a teaching aid to assist in teaching a young child or other person how to tie his or her own shoelaces by correlating the various steps of the shoelace-tying process to a story or other logical sequence of events that the child is familiar with or can quickly learn so that an adult can readily explain the steps of the process to the child and the child can more easily understand, learn and remember the process. A teaching aid according to the present invention is a special shoelace having distinguishable segments provided thereon which are arranged in a predetermined pattern and at predetermined positions on the shoelace so as to provide a guide for describing the manner in which the shoelace is to be manipulated during the tying process.

What is needed is an actual attachment to each free end of a lace on one of a pair of footwear positioned at the apex of where each of the bows would normally be formed to tie the lace so that each attachment acts as a pull tab to be gripped by a child to make it easier for a child to tie the lace on the footwear by providing an easier point to push through the hole and to pull on to cinch down the bow. Thus one learns to tie the lace rapidly and easily, wherein the pull tabs remain on the laces as a decorative element so that they are always on the lace to assist the child whenever the lace needs tying until the child is ready to remove the device from the one lace first and then the second and tie on their own.

BRIEF SUMMARY OF THE INVENTION

An object of the present invention is to provide an actual attachment to each free end of a lace on one of a pair of footwear positioned at the apex of where each of the bows would normally be formed to tie the lace so that each attachment acts as a pull tab to be gripped by a child to make it easier for a child to tie the lace on the footwear by providing an easier point to push through the hole and to pull on to cinch down the bow and thereby learn to tie the lace rapidly and easily, wherein the pull tabs have indicia thereon to be used in the shoelace tying teaching method of the present invention which involves telling an action story to a child using the indicia in the action story wherein the characters and other images on the pull tabs move through motions related to the shoelace tying process, wherein the pull tabs remain on the laces as a decorative element so that they are always on the lace to assist the child whenever the lace needs tying until the child is ready to remove the device from the one lace first and then the second and tie on their own.

One more object of the present invention is to provide decorative indicia on the pull tab to match a child's shoes or outfits or a character or object that the child relates to emotionally.

A corollary object of the present invention is to provide a storyline which is used in conjunction with the indicia on the pull tabs to further assist in teaching a child to tie their shoelaces.

An additional object of the present invention is to provide two spaced apertures through the shoelace pull tab which are tapered to squeeze the lace and angled to create friction through which the lace end on lace member is threaded up through a first aperture and down through a second aperture to create a secure gripping tab which will not slide/move its position on the newly created loop end of said lace members.

Yet another object of the present invention is to provide a shoelace tab which cannot be moved by a child and may only be removed by an adult.

A final object of the present invention is to provide a shoelace tab which mounts on a shoelace and creates an apex gripping point, thereby eliminating the confusion created by large loops when tying a bow.

In brief, the present invention combines a facilitating component with a teaching component. The device consists of a small square/round or other geometrical device, beadlike in appearance comprising two vertical tunnel holes which are tapered to squeeze the lace and angled to create friction, through which the lace end on lace member is threaded up through and down through to create a gripping tab which will not slide/move its position on the newly created end of said lace members. The tapered tunnel is adapted to accommodate any lace size and effectively pinches/squeezes the lace parts creating a non-moveable point. The purpose of the beadlike device is to provide a grip or pull tab for children to manipulate the laces into a bow to facilitate the lace tying process and make lace tying easier to learn.

The primary advantage of the present invention it provides an entertaining teaching method using an action story involving the indicia on the pull tabs which facilitate lace tying as well as providing the figures for the action story.

An advantage of the present invention is that it is easily manipulated by a child.

Another advantage of the present invention is that it remains securely in position until an adult removes it.

One more advantage of the present invention is that it may be attractively shaped or decorated.

An additional advantage of the present invention is that it forms small, non-confusing looped ends.

Another advantage of the present invention is that it does not impede the tying of the initial crossover when tying one's laces.

Yet another advantage of the present invention is that the laces may still be untied as usual by simply pulling on one end of a shoelace.

A further advantage of the present invention is that it is easy to install.

A contributory advantage of the present invention is that it is economical to manufacture.

BRIEF DESCRIPTION OF THE SEVERAL VIEWS OF THE DRAWINGS

These and other details of my invention will be described in connection with the accompanying drawings, which are furnished only by way of illustration and not in limitation of the invention, and in which drawings.

DETAILED DESCRIPTION OF THE INVENTION

In FIGS. 1-4, a shoelace tying device 20 attaches to each free shoelace end 31A and 31B to form a loop 32A and 32B in the shoelace end 31A and 31B for facilitating shoelace tying and teaching shoelace tying.

Figure 1:
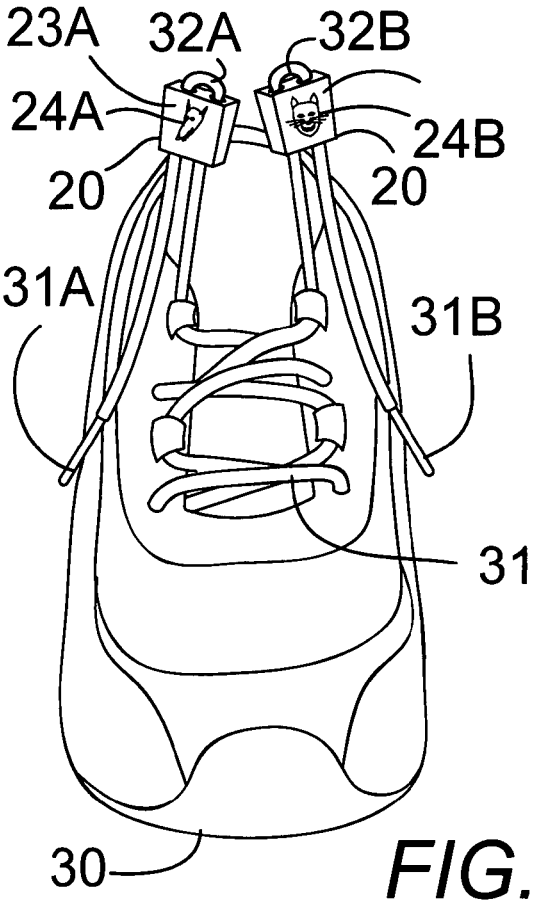
FIG. 1 is a perspective view of the pair of shoelace tying pull tabs of the present invention shown mounted on the two ends of a shoelace to form a pull-tab apex in the lace.
Figure 3:
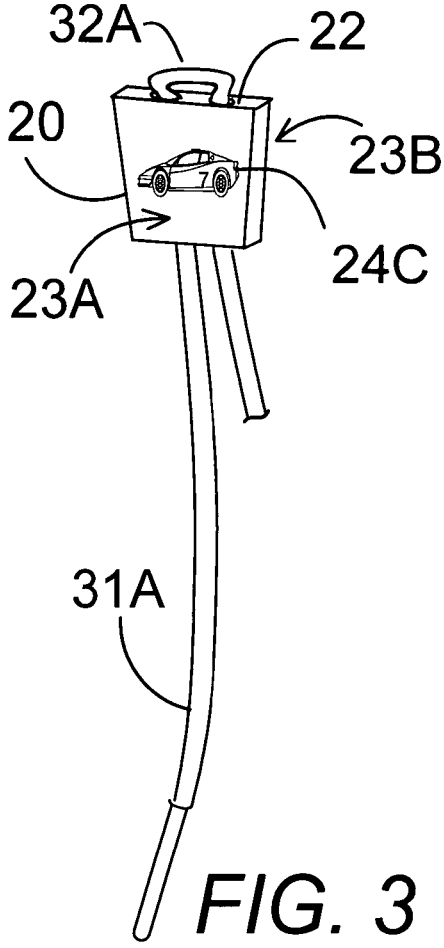
FIG. 3 is a perspective view of a single pull tab of the present invention bearing a character image mounted on a shoelace.
Figure 2A:
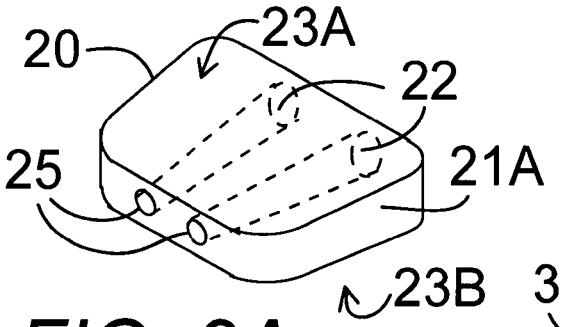
FIG. 2A is a perspective view of a rounded tapered rectangular wedge shaped pull tab of the present invention.
Figure 2B:
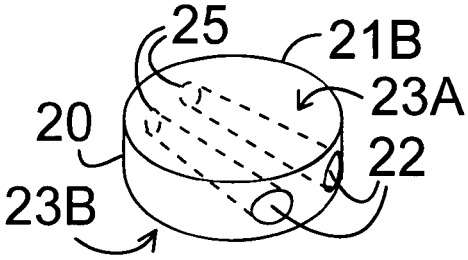
FIG. 2B is a perspective view of a circular wedge shaped pull tab of the present invention.
Figure 4:
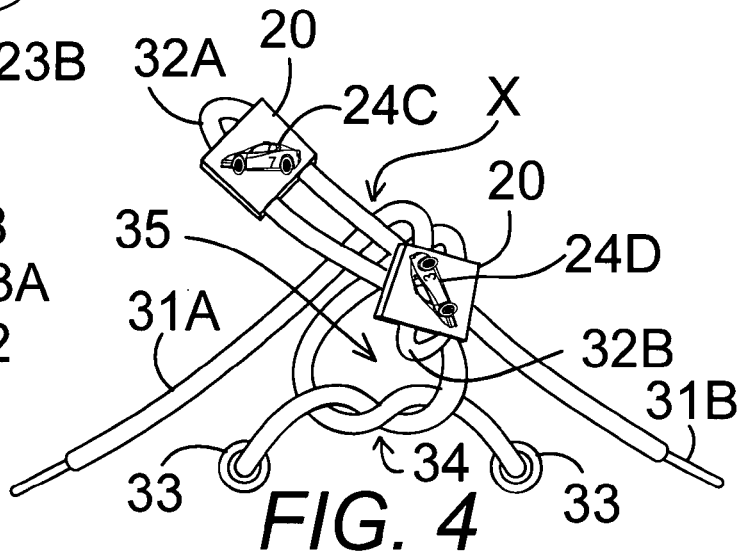
FIG. 4 is a perspective view of a pair of shoelace pull tabs of the present invention being tied into a bow.

A pair of shoelace pull tabs 20 are provided, each attached to a mid-portion of each free lace end 31A and 31B forming a loop 32A and 32B in each of the laces 31A and 31B with the pull tab 20 at an apex of the loop 32A and 32B, as shown in FIGS. 1, 3 and 4, for gripping by a child. The pull tab 20 comprises a planar tab 20 having a front gripping surface 23A and a back gripping surface 23B for a child to grasp, as shown in FIGS. 2A, 2B, and 3. The pull tab 20 has two spaced apertures 22 therethrough (best seen in FIGS. 2A and 2B) between the gripping surfaces 23A and 23B and in spaced relation to the gripping surfaces 23A and 23B. The apertures 22 are tapered to squeeze the lace and angled to create friction in order to retain the lace 31A and 31B immovably therein. The apertures 22 effectively pinch/squeeze the lace parts 31A and 31B in narrow openings 25 so the pull tab is not moveable by a child. The lace end 31A and 31B is threaded up through a first aperture 22 and down through a second aperture 22 to retain the pull tab 20 in place at the apex of the loop 32A and 32B, thereby providing a pull tab 20 for a child to grip to manipulate the laces 31A and 31B into a bow, as shown in FIG. 4. The pull tabs 20 facilitate and teach lace tying and remain attached to the lacing until removed by an adult.

Each of the pull tabs 20 bear indicia 24A-24D thereon as a teaching device for shoelace tying as well as a pleasing decorative fixture remaining on the shoe which may match the footwear color or style and may provide a symbol or figure or character to which the child relates. The visual indicia 24A-24D on the pull tabs 20 assist the tying process by being used in the method of teaching a child to tie shoelaces, including creating stories based on the indicia and how the story provides action related to the movement of the figures of the indicia which coincides with the shoelace tying process. The pull tabs 20 may also bear decorative matter, such as colors or shapes, such as a rounded rectangular shape form 21A, as shown in FIG. 2A or a rounded shape form 21B as shown in FIG. 2B.

A shoelace tying method is also provided for facilitating shoelace tying and teaching shoelace tying. The method comprises a first step of attaching each one of a pair of shoelace pull tabs 20 to a mid-portion of each free lace end 31A and 31B forming a loop 32A and 32B in the lace 31A and 31B with the pull tab 20 at an apex of the loop 32A and 32B for gripping by a child, as shown in FIGS. 1, 3 and 4. The pull tab 20 comprises a planar tab 20 having a front gripping surface 23A and a back gripping surface 23B for a child to grasp. The pull tab 20 also has two spaced apertures 22 therethrough between the gripping surfaces 23A and 23B and spaced relation to the gripping surfaces 23A and 23B. The apertures 22 have a high friction surface lining to retain the lace 31A and 31B immovably therein. The first step is completed by threading a lace end 31A and 31B up through a first aperture 22 and down through a second aperture 22 to retain the pull tab 20 in place at the apex of the loop 32A and 32B thereby providing a pull tab 20 for a child to grip to manipulate the laces 31A and 31B into a bow; the pull tabs 20 remain attached to the lace 31A and 31B, as shown in FIGS. 1, 3 and 4, thereby facilitating and teaching lace tying.

The method also comprising using indicia 24 on each of the pull tabs 20 as a teaching device for shoelace tying. The method may further comprise indicia 24 having visual indicia 24A-24D on the pull tabs 20 to be used in a method of teaching a child to tie shoelaces.

In use, one of the present invention pull tab devices 20 is mounted on each lace member 31A and 31B by an adult approximately 3 inches up from the base of the lace 31A and 31B where it exits the top eyelet 33 of a shoe 30, as shown in FIGS. 1 and 4. This is accomplished by threading the lace member end 31A and 31B up through a first inner aperture 22 until it rests approximately 3 inches from the base of said lace 31A and 31B at which point the lace 31A and 31B is threaded back down through a second outer aperture 22 creating a "thumb/pull tab" 20 at the loop apex 32A and 32B, as shown in FIGS. 1, 3 and 4. The pull tab 20 is not removable by children but can be removed by an adult, due to the frictional rubberized lining in the apertures 22.

The pull tab device 20 is appealing to children as it comes in popular colors with an imprint or graphic indicia 24A-24D on the gripping surface 23A and 23B of each device 20 making it desirable to wear on their shoes 30. The graphic or other indicia 24A-24D and color are used in the method/aid to teach and assist children to learn the motion of crossing the joined lace members 31A and 31B and tucking one pull tab device 20 through the hole 35 formed from the aforementioned crossing of the lace 31A and 31B (see FIG. 4), at which point the child pulls on each pull tab device 20 to finish the tying process. This is done through using a storyline method of teaching shoelace tying including the indicia 24A-24D as a subject of the story.

In FIG. 4, the present invention offers a teaching method for tying shoelaces that ultimately allows the child to create a more secure knot. The method uses the fixed loop ends 32A and 32B created by the pull-tabs 20 and instructs the child to make an "x" or cross the two tabs and make one tab go into the hole 35 created by the "x". This method is enhanced and made clearer using characters depicted on the pull tabs mentioned above which play a role in the teaching of the method. For example; it becomes a game where the red race car 24D (car #3) chases the blue race car 24C (car #7) around and into the pit or "hole" 35.

In another example of FIG. 1, a first loop end 32B with a pull tab device 20 depicting a cat or kitten 24B could have the cat chase around the loop end 32A of a second device 20 depicting a mouse 24A and have the first loop end 32B go into the hole 35 formed, shown in FIG. 4, which could be called "the mouse hole" in the storyline.

The pull tab devices 20 are mounted and are left on the laces 31A and 31B until the child becomes proficient performing the tying of the bow, at which time one of the devices 20 is removed leaving the child to learn to hold the lace members 31A and 31B together at the same point without the device 20 on his/her own. Once this is accomplished the second device 20 can be removed and the child can complete the education process of learning to tie their own laces 31A and 31B.

Previous devices lack the teaching element and mechanically inhibit tying the first cross-over 34 when and if they are permanently mounted whereas the proposed device 20 allows the initial crossover 34 to be performed in the regular manner using the lace member ends 31A and 31B. Due to their positioning and structure, the devices 20 pass over one another easily allowing the base cross 34 to be tied, as shown in FIG. 4. Other prior art creates a large loop which causes some confusion as to which loop goes through which loop/hole. Additionally, the child is expected to apply said prior art device on their own when no adult is able to help.

The pull tab device 20 of the present invention is semi-permanently mounted until the child is ready to move to the next step of learning and does not inhibit the first cross-over step 34 of tying a shoe 30, the bow making or the untying of the shoe 30. The device 20 is adapted to be mounted on the apex of the lace 31A and 31B, thereby leaving a pull-tab 32A and 32B and avoiding the "bunny ear" or "loop" teaching method of prior art. The present invention 20 simplifies the tying confusion created by having multiple loops and holes to complete a bow. A child's dexterity develops with age therefore a fixed device 20 which aides in teaching the actual motion of bow tying is preferable to mounting or dismounting of said device 20 each time the lace 31A and 31B is tied or untied. The pull tab 20 removes the guesswork out of where to hold the "loop" 32A and 32B in order to pull it through and complete a bow, as shown in FIG. 4 and creates an easy point to push through the "hole" and pull to cinch down the bow. The present invention device 20 provides a definitive grasping point 23A and 23B and therefore focuses on the motion and placement first. It also sets the child up to learn a preferable tying method as they get older. The method provided creates a much more secure knot which can still be untied by pulling on one lace member end 31A and 31B.

The indicia 24A-24D, seen in FIG. 3, may be applied on or formed as part of the pull tab 20 using methods from a list of methods including; painting, printing, stamping, etching, molding, imprinting, silk screening, adhesive mounting, extruding, using decals or any other method of applying indicia.

It is understood that the preceding description is given merely by way of illustration and not in limitation of the invention and that various modifications may be made thereto without departing from the spirit of the invention as claimed.

What is claimed is:

1. A shoelace tying device for facilitating shoelace tying and teaching shoelace tying, the device comprising:

a pair of shoelace pull tabs each attached to a mid-portion of each free lace end forming a pull tab at an apex of a formed loop of each lace for gripping by a child, the pull tab comprising a planar tab having a front gripping surface and a back gripping surface for a child to grasp, the pull tab having two spaced apertures therethrough between the gripping surfaces spaced from the gripping surfaces, the apertures are tapered to squeeze and angled to create friction in order to retain the lace immovably therein, the lace end being threaded up through a first aperture are tapered to squeeze and angled to create friction in order to retain the pull tab in place at the apex of the loop thereby providing a pull tab for a child to grip to manipulate the laces into a bow, the pull tabs facilitating and teaching lace tying, the pull tabs remaining attached to the lace; and indicia exposed on at least one gripping surface of each of the pair of shoelace pull tabs, wherein the indicia represents a topic of interest of an action story used in teaching shoelace tying wherein the topic of interest engages in activity related to the action involved in shoelace tying.

2. The device of claim 1 wherein the apertures are tapered to squeeze and angled to create friction and effectively hold the pull-tab in place.

3. The device of claim 1 wherein the pull tabs bear decorative matter to match the footwear of the child.

4. A shoelace tying method for facilitating shoelace tying and teaching shoelace tying, the method comprising:

a first step of attaching each one of a pair of shoelace pull tabs to a mid-portion of each free lace end forming a pull tab at an apex of a formed loop for gripping by a child, the pull tab comprising a planar tab having a front gripping surface and a back gripping surface for a child to grasp, the pull tab having two spaced apertures therethrough between the gripping surfaces spaced from the gripping surfaces, the apertures tapered and angled to retain the lace immovably therein, and threading the lace end up through a first aperture and down through a second aperture to retain the pull tab in place at the apex of the loop thereby providing a pull tab for a child to grip to manipulate the laces into a bow, the pull tabs facilitating and teaching lace tying, the pull tabs remaining attached to the lace;

a second step of using indicia exposed on at least one gripping surface of each of the pair of shoelace pull tabs to tell an action story to the child, wherein the indicia represents a topic of interest of the action story used in teaching shoelace tying wherein the topic of interest engages in activity related to the action involved in shoelace tying.

* * * * *